US005637017A

United States Patent [19]

Hsu

[11] Patent Number: 5,637,017

[45] Date of Patent: Jun. 10, 1997

[54] ELECTRICAL PLUG STRUCTURE

[76] Inventor: Chao-Chih Hsu, No. 10, Alley 4, Lane 13, Cheng Kung Road, Hsinchu, Taiwan

[21] Appl. No.: 491,778

[22] Filed: Jun. 19, 1995

[51] Int. Cl.[6] ..... H01R 13/68

[52] U.S. Cl. ..... 439/622; 337/198

[58] Field of Search ..... 337/198, 197; 439/622, 621

[56] References Cited

U.S. PATENT DOCUMENTS

| | | | |
|---|---|---|---|
| 4,275,374 | 6/1981 | Chaucer | 439/622 |
| 4,443,050 | 4/1984 | Taylor | 439/622 |
| 4,679,877 | 7/1987 | Ahroni | 337/198 |
| 4,904,976 | 2/1990 | Liaq | 439/622 |
| 5,320,563 | 6/1994 | Liao | 439/622 |
| 5,435,755 | 7/1995 | Chien et al. | 439/633 |
| 5,451,173 | 9/1995 | Mai | 439/622 |
| 5,482,478 | 1/1996 | Liao | 439/622 |

*Primary Examiner*—Gary F. Paumen
*Attorney, Agent, or Firm*—Notaro & Michalos P.C.

[57] ABSTRACT

An electrical plug includes a base body having a front surface on which two blade slots are formed to receive therein conductive blades with the blades partially projecting out of the slots from a top end of the base body. Each of the conductive blades has a sharpened member in electrical connection therewith, wherein one of the conductive blades has a fuse connected between the blade and the sharpened member. A casing is fit over the base body to enclose and retain the blades, together with the sharpened members therein. An end portion of an electrical wire is received within the casing through an opening. The end portion of the wire is guided to run from the front surface of the base body to an opposite rear surface and then back to the front surface through two through holes formed on the base body. The base body further has a central slots formed between the two blade slots to receive the sharpened members therein. The end portion of the wire that extends through the through holes of the base body is also received within the central slot and is forced toward the sharpened members by the fitting of the casing over the base body to have the sharpened members pierce into and establish electrical connection with conductive cores of the wire. The casing may be provided with an access opening for user's access to the fuse.

11 Claims, 7 Drawing Sheets

ELECTRICAL PLUG STRUCTURE

FIELD OF THE INVENTION

The present invention relates to an electrical plug structure.

BACKGROUND OF THE INVENTION

Electrical plugs have been widely used to provide a connection between an electrical or electronic device and an external power source, such as wall outlet. Conventionally, the electrical plugs may have a structure that comprises several parts secured by screws or a structure that is formed by injection molding. The injection molding plugs do not allow a user to fix a malfunctioning or damaged plug. The screw secured plugs, which usually comprises two or three conductive pins or blades with electrical wires connected thereto to be disposed and fixed inside a casing which is usually constituted by two halves secured together by means of screw, requires the electrical wires to be secured to the conductive blades by means of screws or soldering. To screw or solder the electrical wires, which generally have an insulation coating or sheath surrounding a conductive core, to the conductive blades, the wires have to be stripped first to expose the conductive core. It is known that stripping wires and screwing or soldering the naked end portions of wires to the conductive blades of the plug are both a time- and labor-consuming job.

It is therefore desirable to provide an electrical plug structure which requires no screw or soldering in manufacturing so as to overcome such problems.

SUMMARY OF THE INVENTION

An object of the present invention is therefore to provide an electrical plug which requires no soldering or screwing in assembly so as to reduce the labor and cost required in manufacturing electrical plugs.

It is another object of the present invention to provide an electrical plug which needs no stripping of electrical wire during assembly.

It is a further object of the present invention to provide an electrical plug structure which provides engaging holes for receiving the blades of a second plug to establish an electrical connection with the second plug so as to allow more than one plug to plug in one wall outlet.

In accordance with the present invention, there is provided an electrical plug comprising a base body having a front surface on which two blade slots are formed to receive therein conductive blades with the blades partially projecting out of the slots from a top end of the base body. Each of the conductive blades has a sharpened member in electrical connection therewith, wherein one of the conductive blades has a fuse connected between the blade and the sharpened member. A casing fits over the base body to enclose and retain the blades, together with the sharpened members therein. An end portion of an electrical wire is received within the casing through an opening. The end portion of the wire is guided to run from the front surface of the base body to an opposite rear surface and then back to the front surface through two through holes formed on the base body. The base body further has a central slots formed between the two blade slots to receive the sharpened members therein. The end portion of the wire that extends through the through holes of the base body is also received within the central slot and is forced toward the sharpened members by the fitting of the casing over the base body to have the sharpened members pierce into and establish electrical connection with conductive cores of the wire. The casing may be provided with an access opening for user's access to the fuse.

BRIEF DESCRIPTION OF THE DRAWINGS

The present invention will be better understood from the following description of illustrative preferred embodiments thereof, with reference to the attached drawings, wherein.

DETAILED DESCRIPTION OF THE PREFERRED EMBODIMENTS

Figure 1:
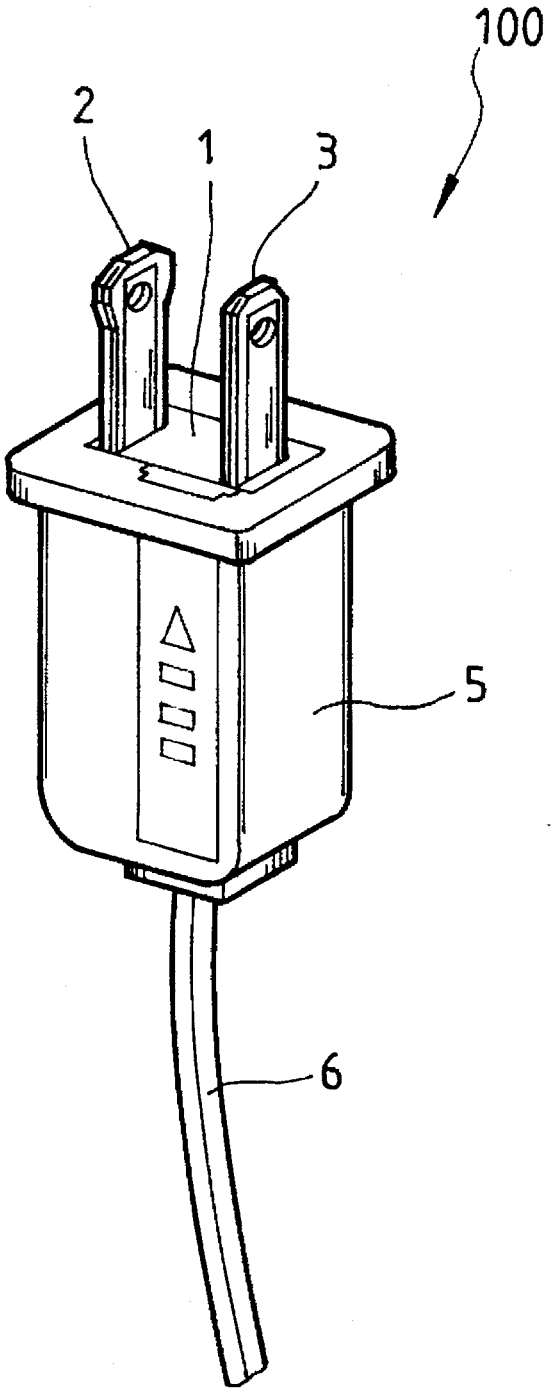
FIG. 1 is a perspective view showing an electrical plug constructed in accordance with a first embodiment of the present invention.
Figure 2:
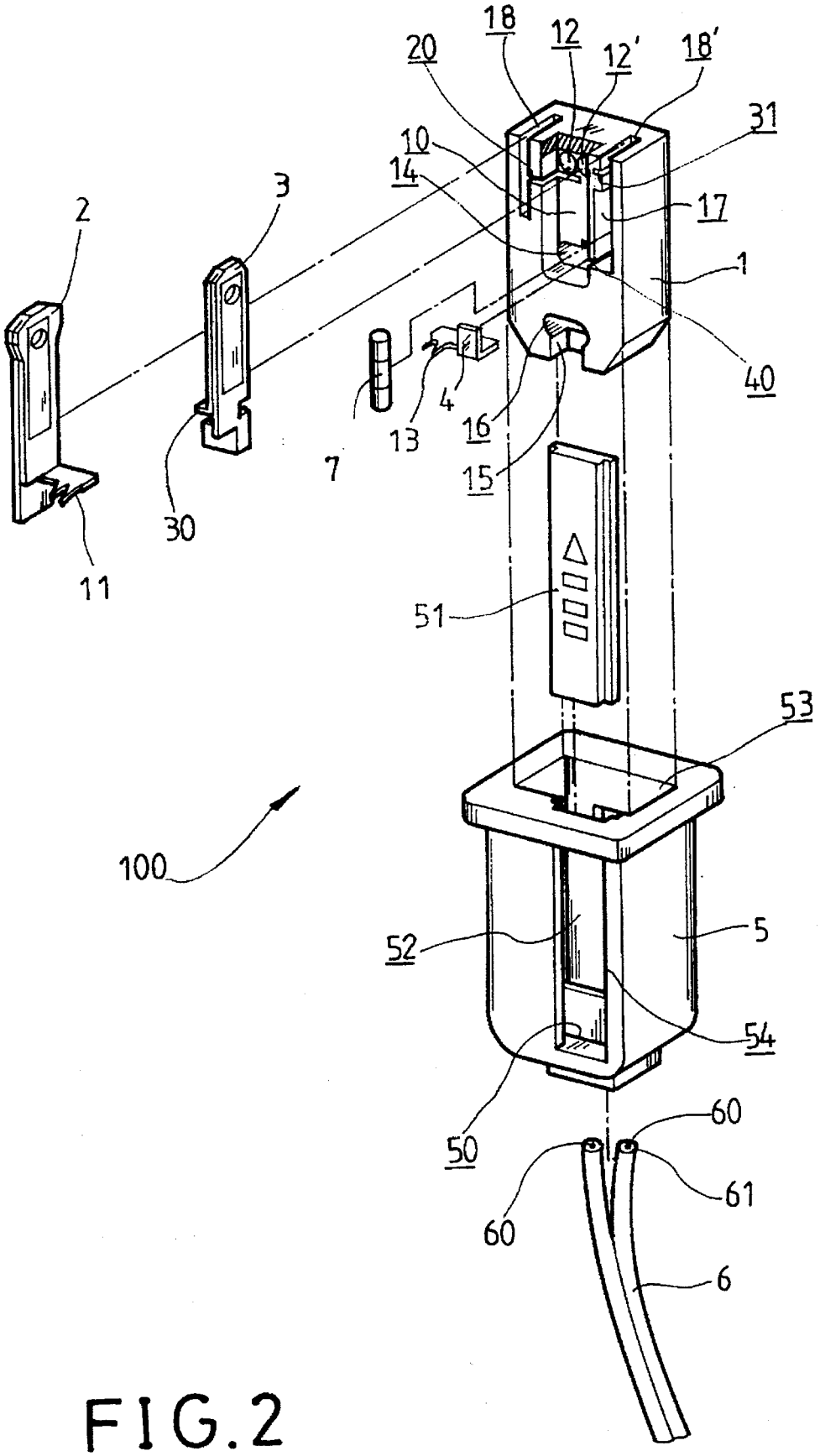
FIG. 2 is an exploded perspective view showing the electrical plug of FIG. 1.

With reference to the drawings and in particular to FIGS. 1–4, wherein an electrical plug constructed in accordance with a first embodiment of the present invention, generally designated with the reference numeral 100, is shown, the electrical plug 100 comprises a base body 1 which has two deep slots 18 and 18' formed thereon to receive therein two conductive blades 2 and 3, respectively, with a casing 5 made of an insulation material tightly fit over the base body 1 and the conductive blades 2 and 3, the blades 2 and 3 being partially projecting out of the casing 5 or the base body 1 from a top end of the base body 1.

The casing 5 has an opening 50 through which an electrical wire 6 having two conductive cores 60 separated and enclosed by insulation sheath 61 extends to have the conductive cores 60 electrically connected to the conductive blades 2 and 3 in a manner to be discussed.

The electrical connection between the wire cores 60 and the conductive blades 2 and 3 will now be discussed. The base body 1 has a front surface on which the two deep slots 18 and 18' are formed and spaced from each other. The base body 1 further comprises a third slot 10 which has a width capable to receive a portion of the wire 6 therein, located between the two blade slots 18 and 18'. The base body 1 also has two channels 14 and 16 of which the first one, channel 14, extending the wire slot 10 to an opposite rear surface of the base body 1. The second channel 16 also extends from the front surface of the base body 1 to the rear surface thereof. A connection channel 15 is formed on the base body 1 and extends from the second channel 15 to communicate with the opening 50 of the casing 5 through which the wire 6 extends for accommodating a portion of the wire 6 therein.

Figure 3:
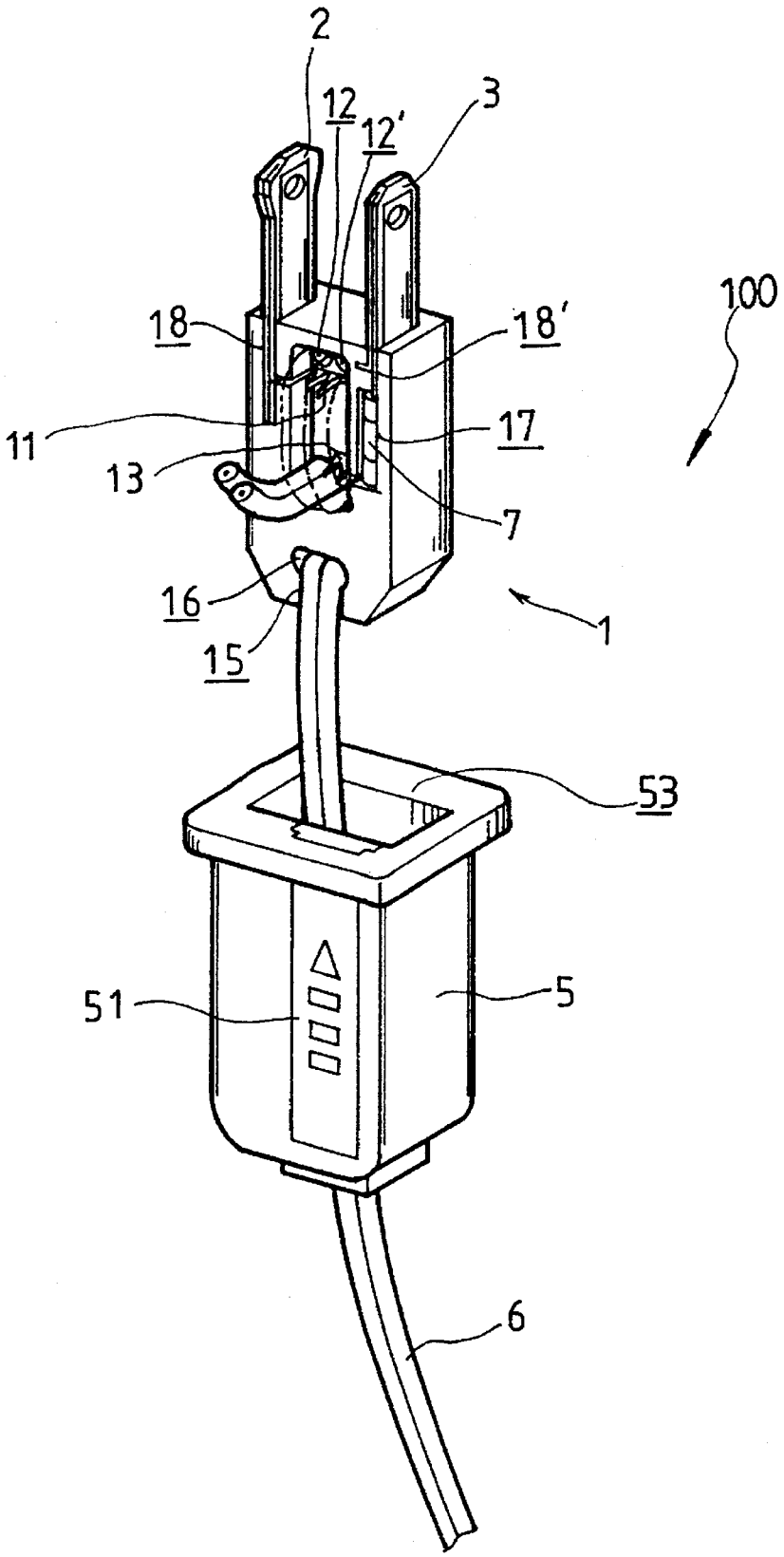
FIGS. 3 and 4 are perspective views showing the assembly of the electrical plug of FIGS. 1 and 2.
Figure 4:
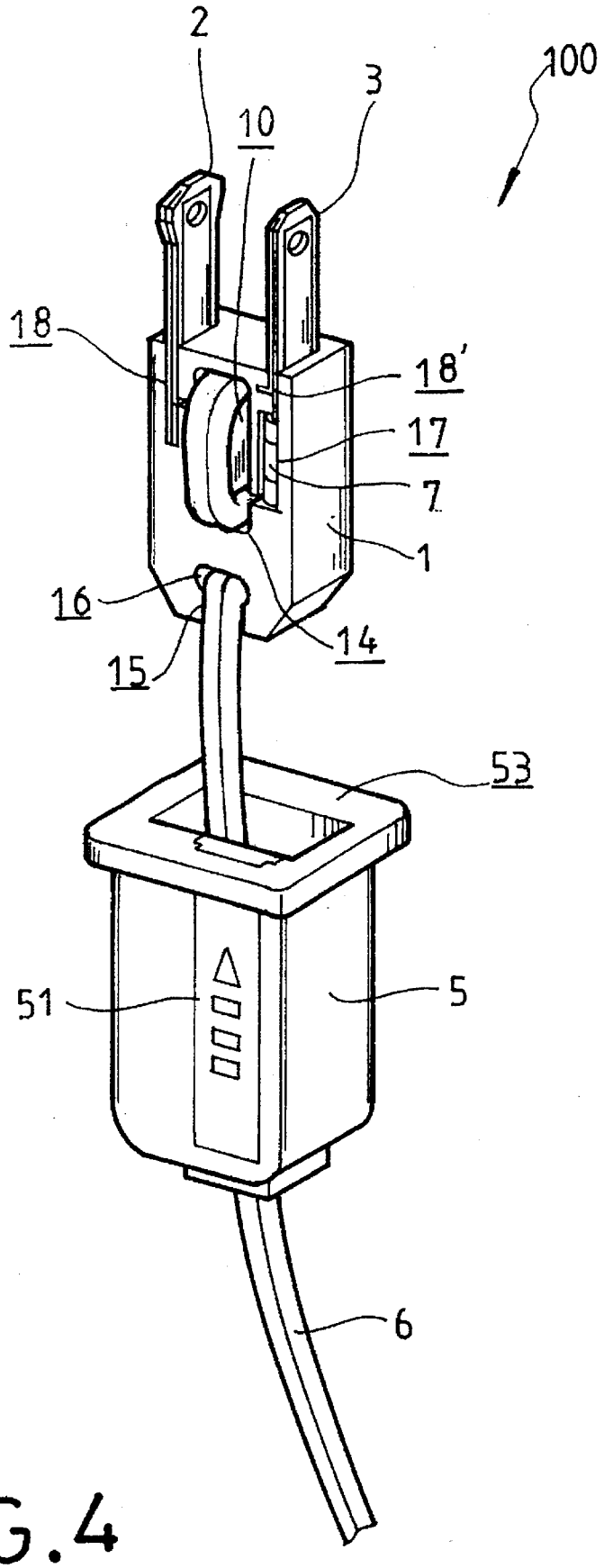

In assembly, a leading end portion of the wire 6 is inserted through the opening 50 of the casing 5 and runs through the connection channel 15 to be guided to extend to the second channel 16. The wire 6 then runs from the front surface of the base body 1 to the rear surface through the second channel 16 and then back to the front surface through the first channel 14 to have a substantial length of the leading end of the wire 6 project out of the first channel 14, as shown in FIG. 3. The leading end of the wire 6 is then separated into two branches and then respectively inserted into holes 12 and 12' formed inside the wire slot 10, as shown in FIG. 4.

The first conductive blade 2 which is received within the blade slot 18 has a conductive sharpened or pointed tip 11 mounted thereto and preferably substantially normal thereto to be tightly received within a slit 20 extending from the first blade slot 18 into the wire slot 10 to allow the sharpened tip 11 of the first blade 2 to be located within the wire slot 10 and opposing one of the two conductive cores 60 of the wire 6 that is received within the wire slot 10.

The tight engagement of the sharpened tip 11 of the first blade 2 serves to securely retain the first blade 2 within the first blade slot 18.

The second conductive blade 3 which is received within the second blade slot 18' has a side lug 30 to be tightly received within a slit 31 extending laterally from the second blade slot 18' to securely retain the second conductive blade 3 within the second blade slot 18'.

The base body 1 has a fuse chamber 17 formed thereon to be in communication with the second blade slot 18' for releasbaly receiving therein a fuse 7 which is so disposed within the fuse chamber 17 to have one conductive terminal thereof in contact and thus electrical engagement with the second blade 3.

A conductive contact member 4 is received in the fuse chamber 17 to be in electrical engagement with a second terminal of the fuse 7. The contact member 4 comprises a conductive sharpened or pointed tip portion 13 extending therefrom to be tightly received within a slit 40 that extends from the wire slot 10 to the fuse chamber 17 so as to allow the tip portion 13 of the contact member 4 to be located within the wire slot 10 to oppose the other one of the conductive cores 60 of the wire 6. The leading end portion of the wire 6 that projects out of the first channel 14 and is located within the wire slot 10 is exactly opposing the two sharpened tip portions 11 and 13, as shown in FIG. 4, to allow the sharpened tips 11 and 13 to respectively pierce into the wire 6.

The casing 5 which has the opening 50 to allow the wire 6 to extend therethrough has an interior space 52 to tightly fit over the base body 1 via an open end 53. The interior space 52 of the casing 5 and the base body 1 are so dimensioned and configured that when the casing 5 is forcibly fit over the base body 1, the wire 6 is pressed toward the sharpened tips 11 and 13 and by so pressing the wire 6, the sharpened tips 11 and 13 are respectively forced to pierce into the wire sheath 61 and to physical contact the conductive cores 60 of the wire 6 so as to establish electrical connection therebetween.

The casing 5 is preferably provided with an access hole 54 which allows a user to access the fuse 7 for purpose of replacement of damaged fuse. A lid 51 is provided to removably cover the access hole 54. The lid 51 may be provided with step-like side flanges to engage corresponding steps formed along the access hole 54 and thus retain the lid 51 on the access hole 54 of the casing 5. Such retaining structure is well known and no further discussion is needed.

Figure 5:
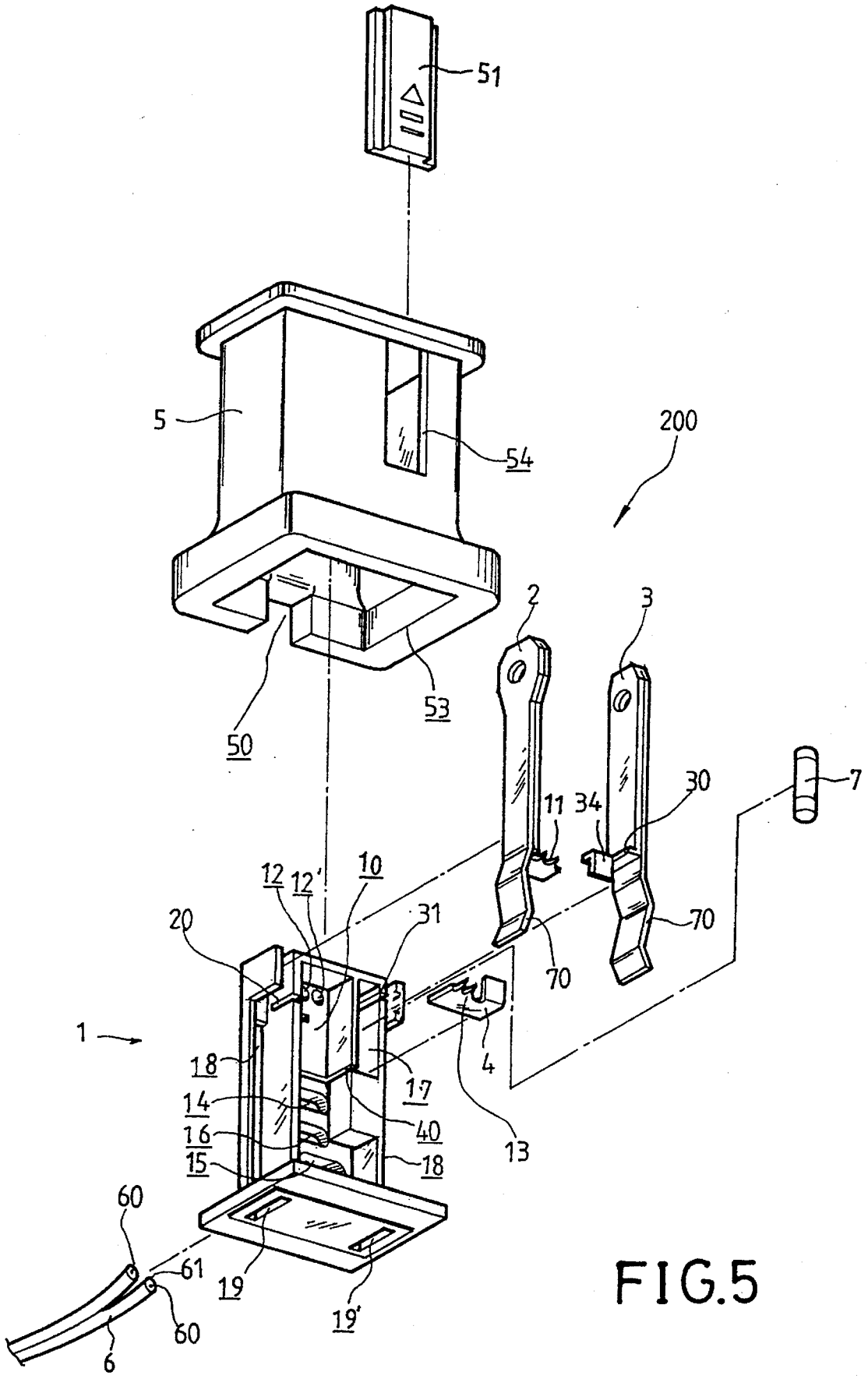
FIG. 5 is an exploded perspective view showing an electrical plug constructed in accordance with a second embodiment of the present invention.
Figure 6:
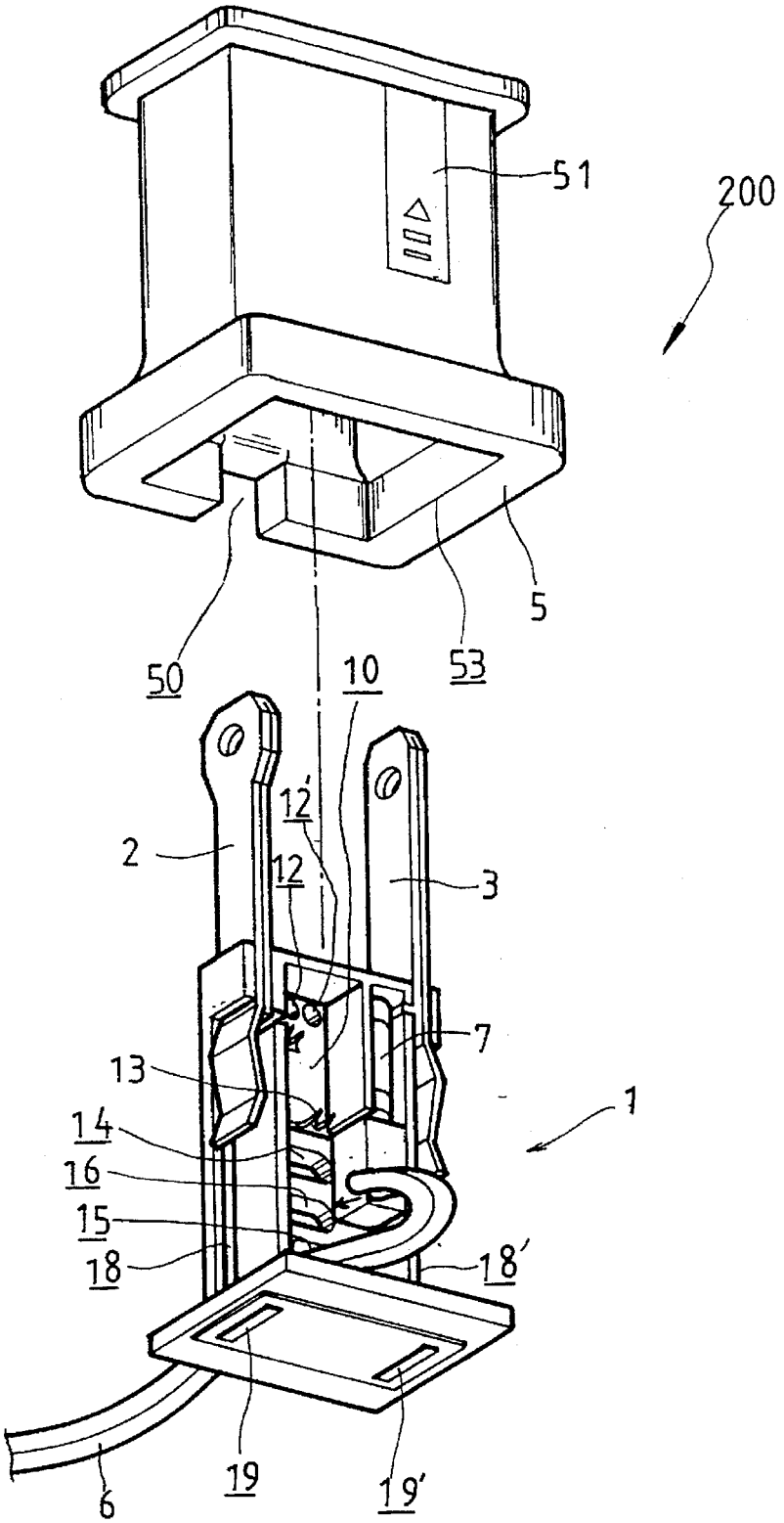
FIG. 6 is a perspective view showing the electrical plug of FIG. 5, with the casing detached.

The structure of the plug embodiment described with reference to FIGS. 1–4 allows only one plug to be used with for example one wall outlet socket. A second embodiment of the electrical plug in accordance with the present invention, which allows a multiplicity of plugs of identical structure to be used with a common wall outlet, is illustrated in FIGS. 5 and 6. In FIGS. 5 and 6, parts or members that are similar to that shown in FIGS. 1–4 bear the same reference numeral.

Referring to FIGS. 5 and 6, the second embodiment of the plug structure of the present invention, which is now designated with the reference numeral 200, comprises a base body 1 having a front surface on which two through channels 14 and 16 and a connection channel 15 are formed. The plug 200 further comprises a casing 5 having an interior space to receive therein the base body 1 via an open end 53 in a tight fitting manner.

The casing 5 has an opening 50 which allows the an electrical wire 6 to extend therethrough to be accommodated by the connection channel 15. A leading end portion of the wire 6 is then inserted through the second channel 16 to extend from the front surface of the base body 1 to an opposite rear surface of the base body 1. The leading end portion of the wire 6 is further inserted into the first channel 14 to run back to and project out of the front surface of the base body 1.

The base body 1 has two spaced slots 18 and 18' into which two conductive blades 2 and 3 are respectively received to partially project out of the base body 1 from a top end thereof. A third slot 10 is formed on the front surface of the base body 1 to be located between the two blade slots 18 and 18'. The leading end portion of the wire 6 that projects out of the first channel 14 is received within the third slot 10 with the leading end thereof respectively inserted into holes 12 and 12' formed inside the wire slot 10.

The first blade 2 has a sharpened or pointed tip portion 11 mounted thereto and substantially normal thereto to be tightly received within a slit 20 which extends from the first blade slot 18 to the wire slot 10 to have the tip portion 11 of the first blade 2 located within the wire slot 10 and opposing one of the conductive cores 60 of the wire 6.

The second blade 3 that is received within the second blade slot 18' has a side lug 30 tightly received within a slit 31 which extends from the second blade slot 18' and in communication with a fuse chamber 17 into which a fuse 7 is releasably received. A contact member 34 is mounted to the side lug 30 of the second blade 3 and located within the fuse chamber 17 to be in contact and thus electrical engagement with a terminal of the fuse 7.

The fuse chamber 17 has a slit 40 extending between the fuse chamber 17 and the wire slot 10. A contact member 4 having a sharpened or pointed tip portion 13 is received within the fuse chamber 17 to be in electrical engagement with a second terminal of the fuse 7 with the sharpened tip 13 located within the wire slot 10 via the slit 40. The sharpened tip 13 of the contact member 4 is located so as to oppose the second conductive core 60 of the wire 6.

Figure 7:
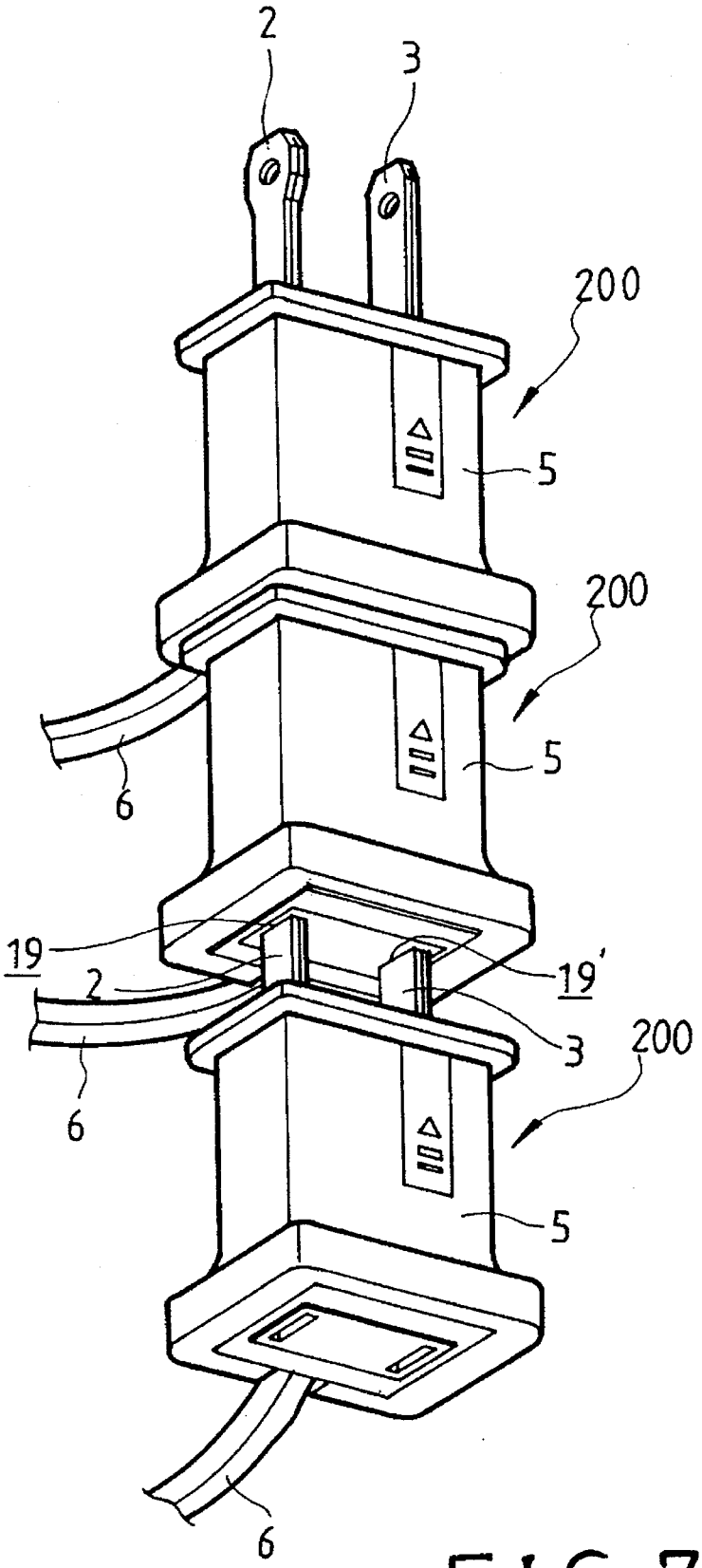
FIG. 7 is a perspective view showing an application of the electrical plug of FIGS. 5 and 6 in which a number of (three) plugs having the same structure are electrically connected together.

On a bottom end of the base body 1, opposite to the top end of which the conductive blades 2 and 3 partially project out, two receiving holes 19 and 19' are formed to be respectively in communication with the blade slots 18 and 18' so that when a second plug is brought to electrically attach to the plug 200 by having the blades of the second plug inserted into the receiving holes 19 and 19', the blades of the second plug establish electrical engagement with the blades 2 and 3 that are disposed within the slots 18 and 18'. This is shown in FIG. 7, in which three plugs of the same structure of plug 200 are shown connected together.

The fitting of the casing 5 over the base body 1 with the wire 6 received within the wire slot 10 and the conductive cores 60 thereof respectively opposing the sharpened tips 11 and 13 forces the wire 6 to move toward the sharpened tips 11 and 13 so as to have the sharpened tips 11 and 13 pierce into the insulation sheath 61 of the wire 6 to establish electrical connection with the conductive cores 60 of the wire 6.

The casing 5 is preferably provided with an access hole 54 which allows a user to access the fuse 7 for purpose of replacement of a damaged fuse. A lid 51 is provided to removably cover the access hole 54.

Further, to provide a more tight engagement between the blades 2 and 3 of the plug 200 and those of a second plug, the blades 2 and 3 are respectively provided with corrugated section 70 which provides resiliency for more securely engagement with the blades of the second plug.

Although the present invention has been described with reference to the preferred embodiments thereof, it is not intended to limit the scope of the present invention with such preferred embodiments and the true scope of the present invention is only defined by the appended claims.

What is claimed is:

1. An electrical plug comprising a base having a first surface on which a first slot and a second slot are formed to respectively receive therein a first conductive blade and a second conductive blade and a third slot to receive therein a leading end portion of an electrical wire which has two conductive cores enclosed and separated by an insulation sheath, a first sharpened member made of a conductive material disposed in the third slot and electrically connected to the first blade and a second sharpened member made of a conductive material disposed within the third slot and in electrical connection with the second blade so as to have the first and second sharpened members respectively opposing the two conductive cores of the wire, an insulation casing, which has an opening through which the leading end portion of the wire extends, being forcibly fit over the base body via an open end of the casing to enclose the base body, the conductive blades, the sharpened members and the leading portion of the wire and to force the sharpened members to pierce into the insulation sheath of the leading portion of the wire to respectively establish electrical connection with the conductive cores of the wire.

2. The electrical plug as claimed in claim 1, wherein the base body comprises a fuse chamber formed thereon to removably receive a fuse therein, the second sharpened member being in contact engagement with a first terminal of the fuse and the second blade being in contact engagement with a second terminal of the fuse to establish an electrical connection between the second sharpened member and the second blade.

3. The electrical plug as claimed in claim 1, wherein the casing has an access hole with a cover removably attached thereto to provide access to the fuse.

4. The electrical plug as claimed in claim 1, wherein the first sharpened member has a section extending through and retained in a slit between the first slot and the third slot to connect to the first blade.

5. The electrical plug as claimed in claim 1, wherein the second blade has a lateral extension received and retained within a slit formed on the first surface of the base body and extending from the second slot.

6. The electrical plug as claimed in claim 2, wherein the first sharpened member has a section extending through and retained in a slit between the third slot and the fuse chamber to contact the first terminal of the fuse and wherein the second blade has a lateral extension received and retained within a slit formed on the first surface of the base body and extending from the second slot to the fuse chamber to be in contact engagement with the second terminal of the fuse.

7. The electrical plug as claimed in claim 1, wherein the base body has two through channels extending from the first surface to an opposite second surface of the base body through which through channels the leading end of the wire is inserted to extend from the first surface of the base body to the second surface through one of the through channels and then back to the first surface through the second one of the through channels to allow the leading end of the wire to be located within the third slot and opposing the sharpened members to be pierced through thereby.

8. The electrical plug as claimed in claim 7, wherein the base body further comprises two holes formed thereon to respectively receive therein an end of each of the conductive cores of the wire that extends through the through channels.

9. The electrical plug as claimed in claim 7, wherein the base body further comprises a connection channel formed on the first surface to extend from the opening of the casing through which the wire extends into the casing to one of the channels to guide the wire from the opening of the casing to the through channel.

10. The electrical plug as claimed in claim 1, wherein the base body comprises two plug in slots formed thereon to be respectively in communication with the first and second slots to be adapted to receive therein two blades of a second plug to electrically connect to the first and second blades.

11. The electrical plug as claimed in claim 10, wherein each of the first and second blades has a corrugated section to more securely engage the blades of the second plug.

* * * * *